US005335503A

United States Patent [19]

Lee

[11] Patent Number: 5,335,503

[45] Date of Patent: Aug. 9, 1994

[54] COOLING METHOD AND APPARATUS

[75] Inventor: Ron C. Lee, Bloomsbury, N.J.

[73] Assignee: The BOC Group, Inc., New Providence, N.J.

[21] Appl. No.: 24,713

[22] Filed: Mar. 1, 1993

Related U.S. Application Data

[63] Continuation-in-part of Ser. No. 896,701, Jun. 10, 1992, abandoned.

[51] Int. Cl.[5] ..... F25D 17/02; F25D 25/00

[52] U.S. Cl. ..... 62/50.1; 62/50.3; 62/62; 62/64; 62/239

[58] Field of Search ..... 62/49.2, 50.1, 50.2, 62/50.3, 50.5, 62, 64, 239

[56] References Cited

U.S. PATENT DOCUMENTS

| | | | |
|---|---|---|---|
| 3,163,022 | 12/1964 | Hottenroth | 62/168 |
| 3,307,366 | 3/1967 | Smith | 62/5 |
| 3,385,073 | 5/1968 | Snelling | 62/45 |
| 3,447,334 | 6/1969 | Kimball | 62/64 |
| 3,464,222 | 9/1969 | Gramse | 62/45 |
| 3,570,262 | 3/1971 | Gramse | 62/89 |
| 4,060,400 | 11/1977 | Williams | 62/162 |
| 4,075,869 | 2/1978 | Fitsall | 62/374 |
| 4,498,306 | 2/1985 | Tyree, Jr. | 62/239 X |
| 4,576,010 | 3/1986 | Windecker | 62/64 |
| 4,726,195 | 2/1988 | Klee | 62/62 |
| 4,768,356 | 9/1988 | Volker | 62/50.5 |
| 5,018,358 | 5/1991 | Lee et al. | 62/48.1 |

FOREIGN PATENT DOCUMENTS

| | | | |
|---|---|---|---|
| 3008355 | 9/1981 | Fed. Rep. of Germany | F25D 3/00 |
| 1581958 | 7/1990 | U.S.S.R. | F17C 9/00 |

*Primary Examiner*—Henry A. Bennet
*Assistant Examiner*—Christopher Kilner
*Attorney, Agent, or Firm*—David M. Rosenblum; Larry R. Cassett

[57] ABSTRACT

A method and apparatus for cooling a heat load in which a pressure vessel is provided to contain a cryogen as a saturated liquid and saturated vapor separated by liquid-vapor interface. The pressure vessel has an inlet adapted to receive a subcooled liquid cryogen and thereby convert it to a saturated liquid through contact with the saturated vapor. A heated overflow tube projects into the pressure vessel and is level, at one end, with the liquid-vapor interface so that any increase in the saturated liquid overflows into overflow tube and is vaporized to form the saturated vapor. The heat transfer and the reintroduction of the vaporized liquid can be effected through forced circulation provided by an ejector. Preferably the pressure vessel is provided with two outlets for discharging the saturated cryogen as saturated liquid or vapor. One or more ejectors having high pressure inlet(s) in communication with the two outlets of the pressure vessel are provided for drawing the heat transfer fluid, after having cooled the heat load, into a heat transfer relationship with the overflowed saturated liquid and then into mixture(s) with the saturated liquid or saturated vapor, or both and for discharging the same out of a high pressure outlet of the ejector to the heat load.

15 Claims, 2 Drawing Sheets

COOLING METHOD AND APPARATUS

REFERENCE TO RELATED CASE

This is a Continuation-in-Part of application Ser. No. 07/896,701, filed Jun. 10, 1992, now abandoned.

BACKGROUND OF THE PRIOR ART

The present invention provides a method and apparatus for circulating a heat transfer fluid along a circulation path, by forced circulation, to cool a heat load. More particularly, the present invention relates to such a method and apparatus in which a cryogen, in preferably a subcooled liquid form, is converted into a saturated liquid through contact with a saturated gaseous form of the cryogen, a portion of the total available thermodynamic energy of either the saturated liquid, the saturated vapor, or both, is utilized to at least promote circulation of the heat transfer fluid and the heat transfer fluid is cooled by the saturated liquid and/or the saturated vapor.

The prior art has provided a variety of cooling methods and apparatus in which a cryogen, such as solid or liquid carbon dioxide, liquid nitrogen, etc., is utilized to cool a heat load and to promote circulation of a heat transfer fluid which can comprise evolved cryogenic vapor or a mixture of cryogenic vapor and air to and from a heat load. An example of such an apparatus is found in U.S. Pat. No. 3,163,022 in which the heat load comprises perishables contained within an insulated refrigerated compartment. An insulated refrigerant compartment is connected to the refrigerated compartment by supply and return conduits. The refrigerant compartment has a heat exchanger containing dry ice and a nozzle projecting from the heat exchanger into a venturi-type ejector provided within the supply conduit. The dry ice sublimates into a gas and the gas is expelled into the ejector of the supply conduit and then into the refrigerated compartment to cool the perishables. After having been heated through the cooling of the perishables, the gas returns to the refrigerant compartment through the return conduit. The returning gas transfers heat to the dry ice through the heat exchanger and thereafter, mixes with the sublimated gas in the ejector. The ejector produces a low pressure region to draw the returning gas from the refrigerated compartment and past the heat exchanger in the refrigerant compartment. Thus, a portion of the total available thermodynamic energy of the sublimated gas, that is a sum of its enthalpy and its kinetic energy, is being made to perform work in forcing the circulation of the sublimated gas between the refrigerant and refrigerated chambers. At the same time, the cooling potential of the sublimated gas is being used to cool the perishables.

The amount of cooling and circulation are coupled due to the self-pressurizing aspect of the apparatus. Therefore, the degree of cooling and the amount of circulation are necessarily limited. As will be discussed, the present invention provides a cooling method and apparatus in which the cooling supplied and the circulation of the coolant can be independently controlled over a greater range of possible operating conditions than such a prior art device as disclosed in the '022 patent.

SUMMARY OF THE INVENTION

The present invention provides a method of circulating a heat transfer fluid along a circulation path to cool a heat load. In accordance with such method, a cryogen is contained within a pressure vessel as a saturated liquid and as a saturated vapor separated from one another by a liquid-vapor interface. The liquid-vapor interface is maintained at the predetermined level. The cryogen is introduced into the pressure vessel at a temperature of no greater than the saturation temperature of the cryogen and the cryogen is discharged from the pressure vessel in a form of at least one of the saturated liquid and the saturated vapor. After discharge of the cryogen from the pressure vessel, heat is transferred from the heat transfer fluid to the cryogen and the heat transfer fluid is circulated through the circulation path so that the heat transfer fluid cools the heat load and is thereby heated and thereafter, is cooled by the cryogen discharged from the pressure vessel. The circulation of the heat transfer fluid is at least promoted by converting a portion of the total available thermodynamic energy of the saturated cryogen, after discharge thereof, to circulation work.

In another aspect, the present invention provides an apparatus for cooling a heat load. The apparatus is provided with a pressure vessel which is adapted to contain a cryogen as a saturated liquid and as a saturated vapor separated from one another by a liquid-vapor interface. The pressure vessel has an inlet for introducing the cryogen into the pressure vessel at a temperature no greater than the saturation temperature of the cryogen. A heated overflow tube projects into the pressure vessel so that an excess amount of the saturated liquid overflows into the overflow tube and is vaporized to form the saturated vapor. A discharge means is provided for discharging saturated cryogen in a form of at least one of the saturated liquid and the saturated vapor. A means is also provided for heating the heated overflow tube. Additionally, a means is connected to the discharge means that converts at least a portion of the total available thermodynamic energy of the saturated cryogen, after discharge thereof, to circulation work for circulating the heat transfer fluid in the circulation path. In the circulation path, the heat transfer fluid cools the heat load and is thereby heated.

In a further aspect, the present invention provides an apparatus for circulating a heat transfer fluid along the circulation path to cool a heat load which again utilizes a pressure vessel. The pressure vessel is adapted to contain a cryogen as a saturated liquid and as a saturated vapor separated from one another by a liquid-vapor interface. The pressure vessel has an inlet for introducing the cryogen into the pressure vessel at a temperature of no greater than the saturation temperature of the cryogen and an overflow tube projecting into the pressure vessel so that excess amounts of the saturated liquid overflow into the overflow tube. Discharge means are provided for discharging the cryogen in a form of at least one of the liquid and the vapor from the pressure vessel. A means is connected to the discharge means that converts at least a portion of the total available thermodynamic energy of the saturated cryogen, after discharge thereof, to circulation work for circulating the heat transfer fluid in the circulation path. In the circulation path, the heat transfer fluid cools the heat load and is thereby heated. The aforementioned means cool the heat transfer fluid with the cryogen discharged from the pressure vessel. A heat exchanger is provided with at least one pass connected to the overflow tube. The heat exchanger is positioned and configured to transfer further heat from the heat transfer fluid to the excess amounts of the saturated liquid that have overflowed into the overflow tube. As a result, the heat transfer fluid is cooled prior to being cooled with the cryogen discharged from the pressure vessel. A means is also provided for drawing the excess amounts of the saturated liquid from the overflow tube and through the heat exchanger and for reintroducing the excess amounts of the saturated liquid into the pressure vessel.

The incoming cryogen can be any cryogen having a temperature no greater than saturation temperature and in fact could be two phase flow. Preferably though, the incoming cryogen comprises a subcooled liquid which will be converted into a saturated liquid upon its contact with the saturated vapor. The energy for the conversion comes from a corresponding portion of the vapor condensing into the saturated liquid form. The conversion causes the incoming subcooled liquid to undergo an increase in enthalpy and therefore a corresponding increase in its ability to do the work involved in circulating the heat transfer fluid. In an apparatus employing a heated overflow tube, the heated overflow tube can be heated by tranferring further heat from the heat transfer fluid to excess amounts of the saturated liquid that have overflowed into the heated overflow tube. The further heat transferred will convert the subcooled liquid into the saturated cryogen independent of flow rate and without the use of any additional control systems or other process adjustment techniques over a wide range of operation. These foregoing aspects of the present invention discussed above are important because they allow the actual cooling potential supplied by the apparatus to be adjusted through adjustment of the flow rate of the subcooled liquid. Additionally, the relative amount of work (compared to cooling duty) that can be extracted from the saturated cryogen can be adjusted by varying the source pressure of the cryogen because the enthalpy of the saturated cryogen will be a function of such pressure. The relative amount of work can also be controlled by adjusting the ratio of the gas/liquid withdrawal. Thus, the cooling potential supplied and the work extracted from the cryogen can be independently predetermined in an apparatus in accordance with the present invention.

It is important to note that the term "subcooled liquid cryogen" means any cryogen in liquid form having a temperature below the saturation temperature of the cryogen. Furthermore, "heat transfer fluid" as used herein and in the claims can mean the cryogen itself. For instance, the saturated cryogen, either in liquid form or gaseous form or a combination of the both, can be circulated to and from a heat load and then be recooled by mixing with saturated cryogen being discharged from the pressure vessel. Alternatively, "heat transfer fluid" can be a mixture of the cryogen, initially discharged as the saturated cryogen from the pressure vessel, and another fluid such as air present within a refrigerated container. Additionally, "heat transfer fluid" can be completely distinct from the cryogen, for instance air circulating within a refrigerated container that never comes into direct contact with the cryogen. As will be discussed, the constituency of the "heat transfer fluid" depends on the physical embodiment in which the present invention is utilized. Furthermore, the term "total thermodynamic energy" of the saturated cryogen means a sum of its enthalpy and its kinetic energy.

BRIEF DESCRIPTION OF THE DRAWINGS

While the specification concludes with claims distinctly pointing out the subject matter that Applicant regards as his invention, it is believed that the invention will be better understood when taken in conjunction with the accompanying drawings in which:

DETAILED DESCRIPTION OF THE INVENTION

Figure 1:
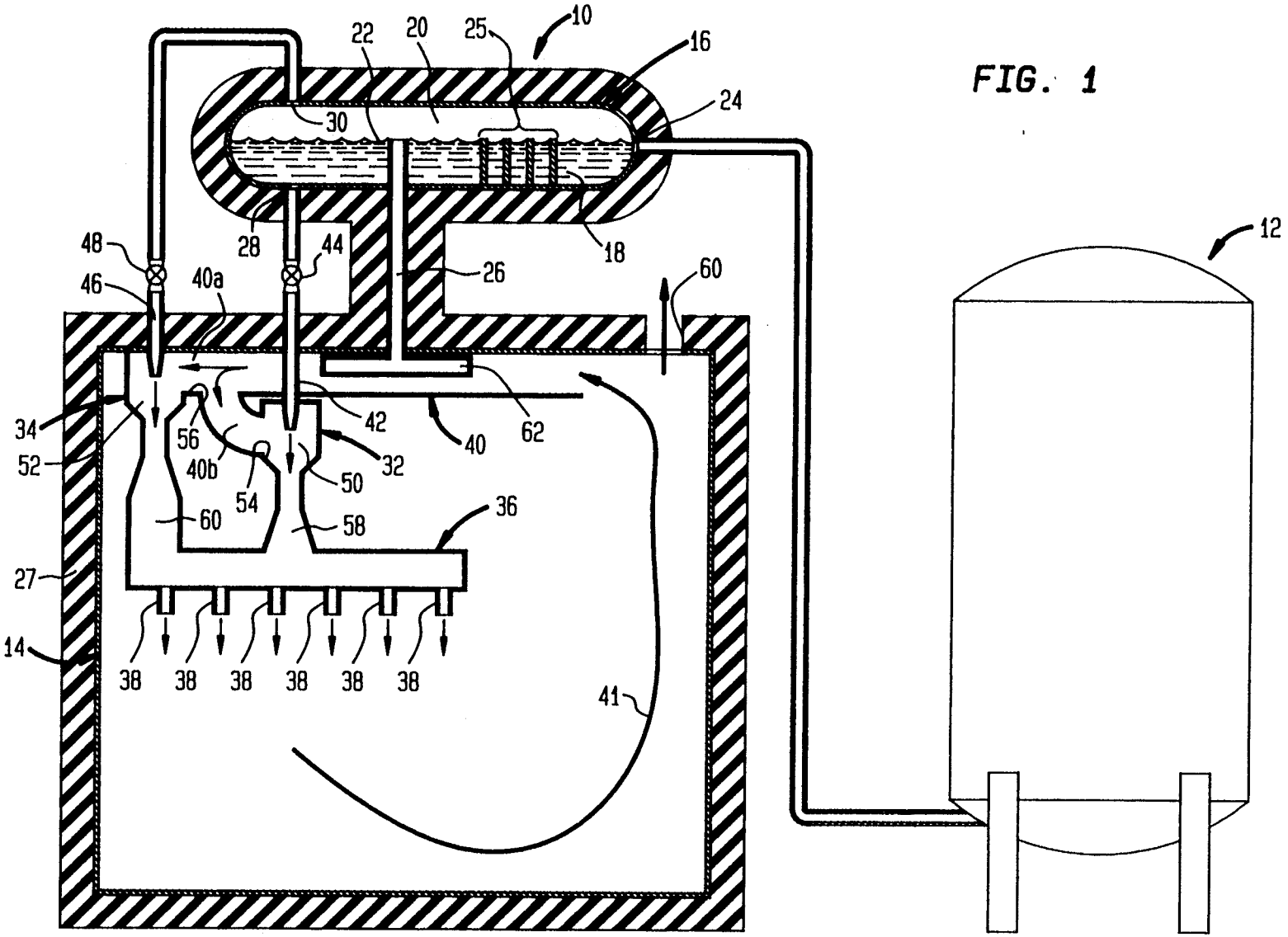
FIG. 1 is a cross-sectional view of a cryogenic forced circulation cooling apparatus in accordance with the present invention connected to a storage vessel for storing a subcooled liquid cryogen.

With reference to the FIG. 1, an apparatus 10 in accordance with the present invention is illustrated. Apparatus 10 is connected to a storage vessel 12 which is specifically designed to contain liquid nitrogen in a subcooled state. Storage vessel 12 is a pressure vessel and can be designed to contain other cryogens such as liquid carbon dioxide, liquid oxygen, liquid argon, etc. In this regard, the term "cryogen" will be understood to mean, herein and in the claims, liquid nitrogen, carbon dixoide, oxygen and argon.

As is common and known in the art, storage vessel 12 is the type of storage vessel that has a pressure building and regulating circuit. As such, the pressure of the liquid nitrogen delivered from storage vessel 12 can be predetermined. Apparatus 10 is in turn connected to a refrigerated compartment 14 which could be the trailer of a refrigerated truck or other insulated container for storing perishables. Thus, refrigerated compartment 14 is serving as a heat load to be cooled by apparatus 10. It is worth noting, however, that this is exemplary only and as can be appreciated, the present invention is useful for a variety of cooling applications, for instance cooling applications involving the formation of plastic articles.

Apparatus 10 is provided with a pressure vessel 16 which is adapted to contain nitrogen as a saturated liquid 18 and a saturated vapor 20 separated by a liquid-vapor interface 22. Subcooled liquid nitrogen from storage vessel 12 enters pressure vessel 16 through an inlet 24 thereof. Upon entry, the subcooled liquid nitrogen is converted into saturated liquid 18 as will be described more fully hereinbelow. A series of baffle plates 25 are provided to ensure that entering subcooled liquid nitrogen contacts saturated vapor 20.

It should be pointed out that the illustrative use of subcooled liquid nitrogen is in no way meant to be a limitation on the scope of the present invention. A saturated liquid cryogen, such as saturated liquid nitrogen could be used with apparatus 10. Furthermore, a cryogen could enter pressure vessel 16 under conditions of two phase flow.

An overflow tube 26 projects into pressure vessel 16 and acts to predetermine the level of liquid-vapor interface 22 or in other words the amounts of saturated liquid 18 or saturated vapor 20 that pressure vessel 16 will contain. As will be discussed, saturated liquid 18 and/or saturated vapor 20 is discharged from pressure vessel 16 during use of apparatus 10. The rate of discharge, relative to the rate at which subcooled liquid nitrogen (or for that matter other possible cryogens at other thermodynamic states) enters pressure vessel 16 causes an excess amount of saturated liquid 18 to be produced. This excess amount of saturated liquid nitrogen (saturated liquid 18) will cause saturated liquid 18 to overflow into overflow tube 26. Thus, the level of liquid-vapor interface 22 will remain constant. It should be pointed out that if liquid nitrogen enters pressure vessel 16 under conditions of a saturated two-phase flow, then vapor must be removed from pressure vessel 16 at a greater rate than vapor enters so that an excess amount of saturated liquid is created to overflow into overflow tube 26.

As will be discussed, overflow tube 26 is heated to cause the saturated liquid 18 therewithin to vaporize into saturated vapor 20. When overflow tube 26 is heated, the total amount of heat transfer to saturated liquid 18 will be sufficient to just produce saturated vapor 20 because upon vaporization of saturated liquid 18 within overflow tube 26, saturated vapor 20 will climb overflow tube 26 and thus, essentially, will not participate in any further heat transfer with the heat being transferred to overflow tube 26. The amount of overflow will naturally be the sum of saturated liquid 18 produced through condensation of saturated vapor 20 necessary to convert the incoming subcooled liquid, and any saturated liquid 18 that overflows due to direct gas withdrawal. It is evident that when only saturated liquid 18 is withdrawn, that the heat supplied to overflow tube 26 is effectively transferred in a quantity just sufficient to accomplish the subcooled liquid to saturated liquid conversion.

As illustrated, overflow tube 26, pressure vessel 16, and refrigerated compartment 14 are covered by a layer of insulation 27 in a manner well known in the art.

Pressure vessel 16 is also provided with an outlet 28 to discharge saturated liquid 18 and outlet 30 to discharge saturated vapor 20. The saturated liquid 18 is discharged to an ejector 32 and saturated vapor 20 is discharged to ejector 34. The nitrogen being discharged from pressure vessel 16, or for that matter any other cryogen being utilized, serves as the heat transfer fluid. As will be discussed, the heat transfer fluid can be completely separate and distinct from the cryogen being utilized. In the illustrated embodiment, however, the nitrogen will be discharged from ejectors 32 and 34 into a distributor manifold 36 having distributor nozzles 38. The nitrogen will then in turn be discharged from distributor nozzles 38 onto the article(s) to be refrigerated. This causes heat to be transferred from the article(s) back to the nitrogen. The thus heated nitrogen is then drawn into ejectors 32 and 34 through a branched conduit 40 having two branches **40*a* and 40*b* to mix with saturated liquid 18 and saturated vapor 20 being discharged from pressure vessel 16. The direction of circulation or the circulation path is indicated by arrowhead line 41. It is understood that ejectors 32 and 34 could be connected to refrigerated container 14** or any other heat load to be cooled by supply and return conduits.

More specifically, ejector 32 is provided with a liquid nozzle 42 connected to outlet 28 via control valve 44. A gas nozzle 46 of ejector 34 is connected to outlet 30 by way of a control valve 48. Control valves 44 and 48 are proportional valves to adjust the flow rates of saturated liquid 18 and saturated vapor 20 to ejectors 32 and 34. Liquid nozzle 42 and gas nozzle 46 serve as high pressure inlets to ejectors 32 and 34, respectively. Liquid nozzle 42 and gas nozzle 46 are designed in a manner well known in the art to increase the velocities of saturated liquid 18 or saturated vapor 20 and thereby create regions of low pressure within mixing chambers 50 and 52 of ejectors 32 and 34, respectively. These low pressure regions draw in the heated nitrogen, which in the illustrated embodiment would be heated nitrogen vapor, into low pressure inlets 54 and 56 connected to branches **40*a* and 40*b* of branched conduit 40. Pressure is recovered by diffuser sections 58 and 60 of ejectors 32 and 34. The mixtures of heated nitrogen vapor and saturated liquid and vapor formed within ejectors 32 and 34 are then discharged to the heat load through distributor manifold 36 connected to diffuser sections 58 and 60 which serve as high pressure outlets of ejectors 32 and 34. As can be appreciated by those skilled in the art, in certain applications distributor manifold 36** could be dispensed with.

A pipe 62, sealed at opposite ends, is connected to overflow tube 26 in a T-like configuration to form a heat exchanger employed in transferring further heat from the nitrogen, after having been heated by the heat load, to overflow tube 26 and therefore saturated liquid contained within overflow tube 26. To this end, pipe 62 is contained within branched conduit 40. Alternatively, the present invention contemplates that overflow tube 26 could be heated by a separate heating coil or other means not involving the cryogen or other possible separate heat transfer fluid. This however would not be preferred in that it would add a complexity not present in the illustrated embodiment. Even more importantly, the heating of overflow tube 26 as set forth in the illustrated embodiment conserves cooling. The transfer of further heat from the heat transfer fluid (nitrogen in the illustrated embodiment) cools the nitrogen which is mixed or recycled back into the saturated nitrogen being discharged under pressure from pressure vessel 16.

As can be appreciated, the cooling provided by either saturated liquid 18 and saturated vapor 20 or a mixture of the two can be determined independently of their flow rates and without the use of any additional control systems or other process adjustment techniques. Additionally, the work potential of the saturated cryogen, again either saturated liquid 18, saturated vapor 20, or a mixture thereof can be balanced with its cooling capacity through adjustment of valves 44 and 48. As is known, saturated vapor has more work potential due to its increased enthalpy. Thus, the use of either saturated liquid 18 or saturated vapor or the mixture thereof can determine work potential to be delivered. As mentioned above, the relative amount of work as compared with cooling duty to be extracted from the cryogen whether dispensed solely as a liquid or a gas or a mixture can be additionally controlled through regulation of the outlet pressure of storage vessel 12.

Many design variations are possible in accordance with the present invention. For instance, pressure vessel 16 could be modified to have single outlet, either 28 or 30, to utilize the total available energy and cooling potential of either saturated liquid 18 or saturated vapor 20. In such case, only ejector 32 or ejector 34, as appropriate, would be employed. In this regard it is possible to supply a single ejector with two outlets 28 and 30. In such case, provision would have to be made to mix saturated liquid 18 and saturated vapor 20 either before or in the single ejector utilized. For instance it is possible to produce a single ejector having liquid and gas nozzles 42 and 46 incorporated into its design. Moreover, a single outlet level with liquid-vapor interface 22 could be used in conjunction with a tube projecting into pressure vessel 16 and having a flexible section so that the tube can be raised into saturated vapor 18 or lowered into saturated liquid 20 by an electrically operated solenoid. Additionally, other venturi-type devices could be substituted for ejectors 32 and 34 as are well known in the art. For instance, another type of venturi-type device not illustrated herein but known in the art consists of a device in which an annular nozzle is used to induce high speed flow and a low pressure region. It should therefore be noted that the term "venturi-type device" as used herein and in the claims means any device in which a high pressure motive fluid, for instance the saturated nitrogen discharged from pressure vessel 16 entrains and increases the pressure of an entrained fluid, for instance, the nitrogen after having been heated by the heat load.

In the illustrated embodiment, circulation is produced by ejectors 32 and 34 discharging the nitrogen (comprising mixtures of the saturated vapor and liquid 18 and 20 and recirculated heated nitrogen vapor having been heated by the heat load) and then drawing the heated nitrogen back to ejectors 32 and 34 after having cooled the heat load. Thus, a forced circulation is set up within refrigerated compartment 14 by ejectors 32 and 34. Additionally, the heated nitrogen is then being cooled after having been heated by mixing with saturated vapor and liquid 18 and 20. It should be mentioned that an application of the present invention could involve the addition of auxiliary fans to help the circulation. In such case ejectors 32 and 34 would only help promote circulation.

Ejectors 32 and 34, or for that matter other venturi-type devices that could be substituted therefor, utilize a portion of the total available energy potential of the cryogen, either saturated liquid, saturated vapor or both to produce or at least to promote circulation. Thus, a fluid driven motor connected to a fan could serve the same purpose as ejectors 32 and 34, with of course different performance characteristics. In such case nitrogen would be expelled from the fluid driven motor and the fan would produce circulation of the nitrogen. Another possible embodiment would include a heat exchange coil connected to the outlet of the fluid driven motor and open to the atmosphere. In such embodiment, the heat transfer fluid would comprise resident air contained within the refrigerated container. The air would circulate to be cooled by the heat exchange coil, warmed by the heat load, i.e. perishables, and then drawn into the conduit surrounding the heat exchanger associated with the overflow tube to heat subcooled liquid contained therewithin. As can be appreciated, the air would never mix with the cryogen as in the illustrated embodiment. Thus, the heat transfer fluid of such embodiment would be completely distinct and separate from the cryogen being used to cool the heat transfer fluid and to produce the circulation work involved in circulating the air. In the illustrated embodiment, however, the heat transfer fluid is the cryogen being added to refrigerated container 14 and thus, a vent 60 is provided to vent excess cryogen.

Figure 2:
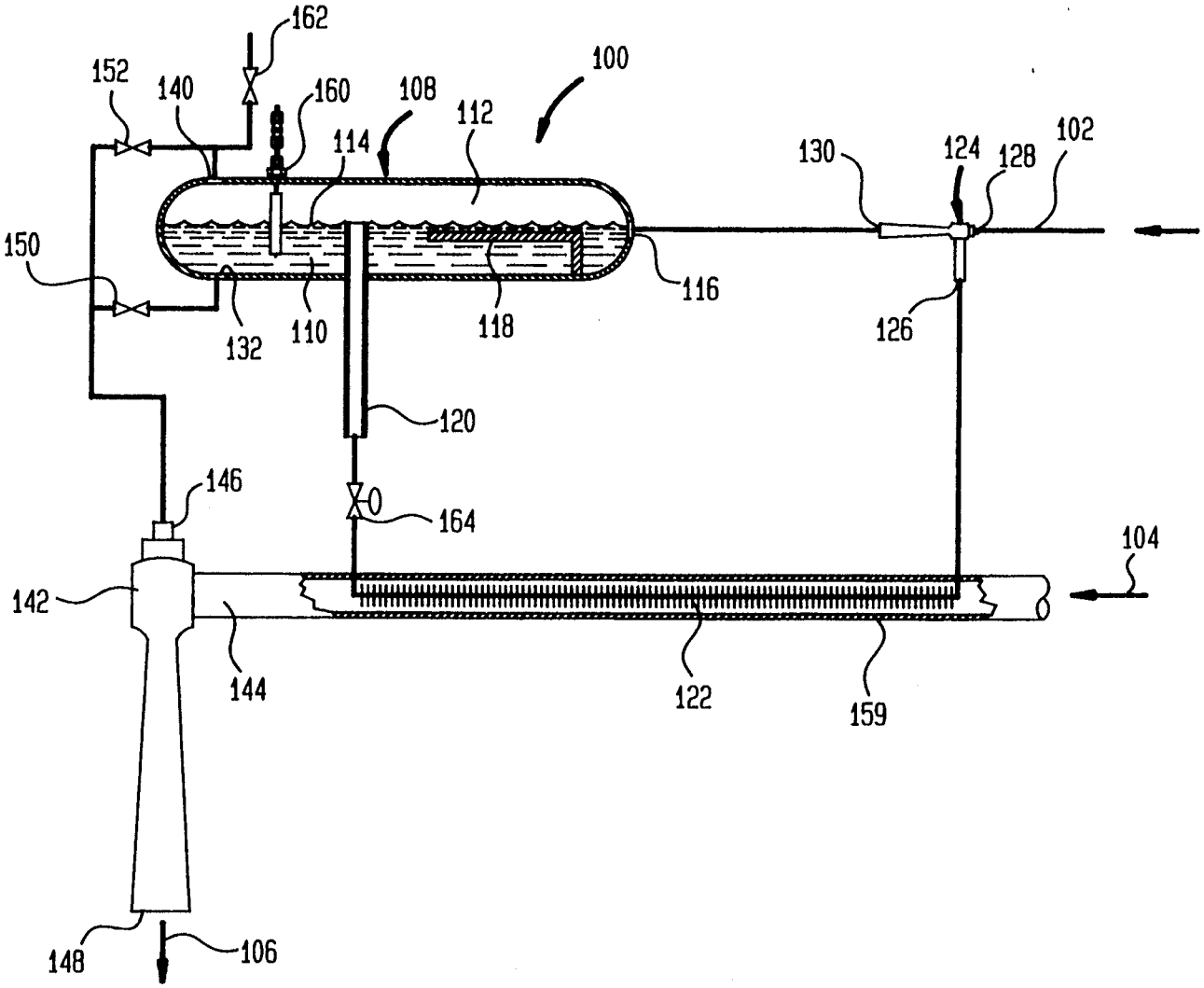
FIG. 2 is a fragmentary, cross-sectional schematic view of a cryogenic forced circulation cooling apparatus in accordance with the present invention.

FIG. 2 illustrates an alternative embodiment of an apparatus 100 in accordance with the present invention. Apparatus 100 in use would be connected to a storage vessel such as storage vessel 12. The liquid cryogen enters apparatus 100 from the storage vessel through an entry line 102. Apparatus 100 could be employed within a refrigerated compartment such as refrigerated compartment 14, in which case, arrowheads 104 and 106 (representing the intake and exhaust of heat transfer fluid) would lie at the end and beginning of the circulation path. Alternatively, apparatus 100 could be used to deliver a cryogenic heat transfer fluid formed of saturated cryogen to an external heat load. Although not illustrated, apparatus 100, in the same manner as apparatus 10, would be encased within insulation to minimize heat leakage.

Apparatus 100 is provided with a pressure vessel 108 which is adapted to contain a cryogen such as nitrogen as a saturated liquid 110 and a saturated vapor 112 separated by a liquid-vapor interface 114. Preferably, subcooled liquid nitrogen enters pressure vessel 108 through an inlet 116 thereof. Upon entry, the subcooled liquid nitrogen is converted into saturated liquid 110. A tray 118 is provided which forces the incoming cryogen to travel in a thin layer along its surface and thereby into an intimate contact with saturated vapor 112 to facilitate the condensing operation.

In apparatus 100, as has been pointed out for apparatus 10, the illustrative use of subcooled liquid nitrogen is in no way meant to be a limitation on the present invention. Furthermore, a saturated liquid cryogen could be used with apparatus 10 as well as a cryogen entering pressure vessel 108 under conditions of two-phase flow. Overflow tube 120 projects into pressure vessel 108 to predetermine the level of liquid-vapor interface 114. Excess amounts of saturated liquid 112 will overflow into overflow tube 120. In apparatus 10, further heat is transferred from the heat transfer fluid to the saturated liquid by way of a heat exchanger, preferably a heat exchanger 122.

It is to be noted that a central advantage of apparatus 10 is its self-regulating nature. That is, a sufficient amount of heat is introduced into apparatus 10 to convert incoming subcooled liquid into saturated liquid by vaporizing excess saturated liquid that has overflowed into the overflow tube with the heat transfer fluid. This self regulation can also be a disadvantage in that it can limit the range of operability of Apparatus 10. For instance, if liquid cryogen is being supplied at too fast a rate or gaseous cryogen is removed from pressure vessel at too fast a rate, conditions of bi-directional flow will occur within overflow tube 26 which can cause it to choke up. Additionally, it is difficult to optimize the design of heat exchanger 62 to take up little space. These problems are by and large solved in apparatus 100 by providing an operation in which flow of saturated liquid is forced through overflow tube 120 and heat exchanger 122.

The conditions of forced flow are effected by means of a first ejector 124 of the same design as ejector 32. Ejector 124 is provided with a low pressure inlet 126 and a high pressure inlet 128. Through a venturi effect, saturated liquid and possibly an amount of entrained gas will be drawn through heat exchanger 122 and then mixed with incoming liquid cryogen to be discharged out of high pressure outlet 130 of first ejector 124 and into inlet 116 of pressure vessel 108. It is to be noted here that the overflowing liquid in case of apparatus 100 will be fully vaporized and in addition may be superheated within heat exchanger 122. In case of no saturated gas withdrawal from pressure vessel 108, then heat exchanger 122 will exchange an amount of thermal energy to exactly effect the conversion of subcooled liquid to saturated liquid without any active control. This operation is similar to that of apparatus 10. Obviously, if withdrawing gas, heat exchanger 122 must also exchange an amount of thermal energy sufficient to supply the gas withdrawn over an amount of gas that may be supplied through inlet 102. Simply stated, the energy through the heat exchanger will automatically satisfy an energy balance between the incoming and outgoing fluid streams of cryogen.

Saturated liquid and/or gas is withdrawn from pressure vessel 108 and is then introduced into a second ejector 142 having a second set of low and high pressure inlets 144 and 146, respectively, and a second high pressure outlet 148. Control valves 150 and 152 control the process in the same manner as control valves 44 and 48 of apparatus 10. Saturated cryogen enters high pressure inlet 146 of second ejector 142 to draw heat transfer fluid, for instance, nitrogen discharged from high pressure outlet 148 of ejector 142 which has already been circulated through the heat transfer path to cool the heat load. A conduit 159 can be provided to enclose heat exchanger 122 and to conduct the heat transfer fluid in a heat transfer relationship with heat exchanger 122 prior to entering low pressure inlet 144 of ejector 142.

Preferably, a level detector 160 is utilized in conjunction with the present invention as well as valves 162 and 164. Level detector 160, fully disclosed in U.S. Pat. No. 5,157,154, is employed to sense a low level of saturated liquid 110 lying below the overflow tube. If saturated liquid reaches such low level with valves 150 and 152 in a closed position, valve 162 would be commanded to open to replenish saturated liquid within pressure vessel 108. Valve 164 would also be commanded to close as it would in case of any detection of the low level of saturated liquid by level detector 160 to prevent further gas generation. Although not illustrated, but as would occur to one skilled in the art, the actuation of valves 160 and 162 in response to the level sensed by level detector 160 and the sensing of position and also possibly the control of valves 150 and 152 would be controlled by a conventional controller. The controller, not illustrated would be either an analog controller or a programmable logic computer programmed to function in the above-referenced manner.

As with apparatus 10, numerous modifications could be made to apparatus 100. For instance, pressure vessel 108 could be modified to have a single outlet, either outlet 132 or outlet 140. Additionally, other venturi-type devices could be substituted for ejectors 124 and 142. As with apparatus 10, auxiliary fans could be utilized to help circulation and/or a fluid driven motor could serve in place of ejector 142. As stated previously, apparatus 100 could be utilized within a refrigeration cabinet and as such, a heat exchange coil could be connected to the outlet of a fluid driven motor with the heat exchange coil open to the atmosphere. In such case the heat transfer fluid would comprise resident air contained within the refrigerated container.

While a preferred embodiment has been shown and described, as will occur to one skilled in the art, numerous additions, omissions and changes can be made without departing from the spirit and scope of the present invention.

I claim:

1. A method of circulating a heat transfer fluid along a circulation path to cool a heat load, said method comprising:

containing a cryogen within a pressure vessel as a saturated liquid and as a saturated vapor separated from one another by a liquid-vapor interface;

maintaining the liquid-vapor interface at a predetermined level by withdrawing excess amounts of the saturated liquid from the pressure vessel, vaporizing the excess amounts of the saturated liquid and thereafter reintroducing the vaporized saturated liquid into the pressure vessel;

introducing the cryogen, at a temperature no greater than the saturation temperature of the cryogen, into the pressure vessel;

discharging the cryogen from the pressure vessel in a form of a least one of the saturated liquid and the saturated vapor;

transferring heat from the heat transfer fluid to the cryogen after discharge thereof; and circulating the heat transfer fluid through the circulation path so that the heat transfer fluid cools the heat load and is thereby heated and thereafter, is cooled by the cryogen discharged from the pressure vessel;

the excess amounts of the saturated liquid being vaporized by transferring further heat from the heat transfer fluid to the saturated liquid prior to the heat transfer from the heat transfer fluid to the cryogen and after the heat transfer fluid has been heated by the heat load;

the circulation of the heat transfer fluid at least promoted by converting a portion of the total available thermodynamic energy of the saturated cryogen, after discharge thereof, to circulation work.

2. The method of claim 1, wherein:

the cryogen upon its introduction into the pressure vessel is in a subcooled state; and the saturated liquid is created by passing the liquid form of the cryogen through the saturated vapor to cause a condensation of a portion of the saturated vapor.

3. The method of claim 1, wherein the heat transfer fluid comprises the cryogen.

4. The method of claim 1 or 3, wherein both the saturated liquid and the saturated vapor are discharged at predetermined rates in order to control the cooling potential and the degree of circulation work provided by the cryogen.

5. An apparatus for circulating a heat transfer fluid along a circulation path to cool a heat load, said apparatus comprising:

a pressure vessel adapted to contain a cryogen as a saturated liquid and as a saturated vapor separated from one another by a liquid-vapor interface;

the pressure vessel having, an inlet for introducing the cryogen into the pressure vessel at a temperature of no greater than the temperature of the cryogen, a heated overflow tube projecting into the pressure so that an excess amount of the saturated liquid overflows into the heated overflow tube and is vaporized to form the saturated vapor; and discharge means for discharging the cryogen in a form of at least one of the liquid and the vapor;

means connected to the discharge means and converting at least a portion of the total available thermodynamic energy of the saturated cryogen, after discharge thereof, to circulation work for circulating the heat transfer fluid in the circulation path so that the heat transfer fluid cools the heat load and is thereby heated and for cooling the heat transfer fluid with the cyrogen discharged from the pressure vessel; and